US011700937B2

(12) United States Patent
Johansen et al.

(10) Patent No.: US 11,700,937 B2
(45) Date of Patent: Jul. 18, 2023

(54) ENCLOSURE ASSEMBLY SYSTEM

(71) Applicant: Grillnetics LLC, Fort Collins, CO (US)

(72) Inventors: Tyler D. Johansen, Fort Collins, CO (US); Darrell Turman, Fort Collins, CO (US)

(73) Assignee: Grillnetics LLC, Fort Collins, CO (US)

( * ) Notice: Subject to any disclaimer, the term of this patent is extended or adjusted under 35 U.S.C. 154(b) by 99 days.

(21) Appl. No.: 17/013,926

(22) Filed: Sep. 8, 2020

(65) Prior Publication Data

US 2022/0071388 A1 Mar. 10, 2022

(51) Int. Cl.

| | |
|---|---|
| ***A47B 47/05*** | (2006.01) |
| ***A47B 47/00*** | (2006.01) |
| ***A47B 96/14*** | (2006.01) |
| ***A47B 96/20*** | (2006.01) |

(52) U.S. Cl.

CPC ..... *A47B 47/05* (2013.01); *A47B 47/0025* (2013.01); *A47B 96/1433* (2013.01); *A47B 96/1441* (2013.01); *A47B 96/206* (2013.01); *A47B 2220/008* (2013.01); *A47B 2220/0052* (2013.01)

(58) Field of Classification Search

CPC . A47B 47/05; A47B 47/0025; A47B 96/1433; A47B 96/1441; A47B 96/206; A47B 2220/0052

See application file for complete search history.

(56) References Cited

U.S. PATENT DOCUMENTS

| | | | | |
|---|---|---|---|---|
| 3,150,903 A * | 9/1964 | Chapman | F16B 12/02 | 217/65 |
| 3,497,279 A * | 2/1970 | Chovanec | A47B 47/05 | 312/257.1 |
| 3,515,451 A * | 6/1970 | Hickey | A47B 47/05 | 312/263 |
| 3,738,726 A * | 6/1973 | Burst | A47B 88/90 | 312/204 |
| 4,034,682 A * | 7/1977 | Bizinover | A47B 47/05 | 211/187 |
| 4,040,694 A * | 8/1977 | Lascarrou | F16B 5/02 | 361/829 |
| 4,379,431 A * | 4/1983 | Clement | A47F 5/101 | 108/1 |
| 4,419,938 A * | 12/1983 | Kaut | A47B 47/05 | 108/190 |

(Continued)

FOREIGN PATENT DOCUMENTS

| | | |
|---|---|---|
| DE | 2709868 A1 * | 9/1978 |
| DE | 2815869 A1 * | 10/1979 |

(Continued)

*Primary Examiner* — Stanton L Krycinski

(74) *Attorney, Agent, or Firm* — Craig R. Miles; CR Miles P.C.

(57) ABSTRACT

Generally, an enclosure and method for assembling an enclosure including a plurality of frame members connected or interconnectable to generate a framework and a plurality of panels fastened or fastenable to the framework. In particular embodiments, enclosure and a method of assembling an enclosure from a kit including prefabricated enclosure sides including interconnectable frameworks fastened to panels configured to overlap adjacent panel edges at the corners upon interconnecting the frameworks.

5 Claims, 13 Drawing Sheets

(56) References Cited

U.S. PATENT DOCUMENTS

| | | | | | |
|---|---|---|---|---|---|
| 4,665,838 | A * | 5/1987 | Minshall | A47B 47/021 | 211/186 |
| 4,934,858 | A * | 6/1990 | Beaulieu | F16B 12/40 | 403/174 |
| 5,463,966 | A * | 11/1995 | Nilsson | F16B 12/34 | 108/193 |
| 5,590,939 | A * | 1/1997 | Piontek | A47B 88/988 | 108/26 |
| 6,764,144 | B2 * | 7/2004 | Insalaco | A47B 47/00 | 312/257.1 |
| 6,920,831 | B2 * | 7/2005 | Lin | A47B 57/408 | 211/187 |
| 7,128,225 | B2 * | 10/2006 | Saltzburg | A47B 96/1441 | 211/187 |
| 7,252,202 | B2 * | 8/2007 | Saltzberg | A47B 57/50 | 211/187 |
| 7,967,401 | B2 * | 6/2011 | Hsu | A47B 47/0033 | 312/111 |
| 8,424,694 | B2 * | 4/2013 | Eustace | A47B 96/1441 | 211/192 |
| 8,672,150 | B2 * | 3/2014 | Chen | A47B 57/50 | 211/187 |
| 8,695,816 | B2 * | 4/2014 | Troyner | A47B 96/1441 | 211/187 |
| 8,733,564 | B2 * | 5/2014 | Fitzgerald | A47B 57/50 | 211/191 |
| 9,241,566 | B1 * | 1/2016 | Chen | A47B 55/00 | |
| 9,709,207 | B1 * | 7/2017 | Huang | B29C 64/25 | |
| 9,888,770 | B1 * | 2/2018 | Chen | A47B 47/027 | |
| 10,376,047 | B1 * | 8/2019 | Ebbesson | A47B 47/0083 | |
| 10,729,245 | B2 * | 8/2020 | Wang | A47B 47/00 | |
| 11,006,750 | B2 * | 5/2021 | Chiu | A47B 96/06 | |
| 11,026,509 | B2 * | 6/2021 | Walker | A47B 47/027 | |
| 11,415,159 | B2 * | 8/2022 | Ronda | A47B 96/1433 | |
| 2005/0103734 | A1 * | 5/2005 | Saltzberg | A47B 57/50 | 211/187 |
| 2007/0062898 | A1 * | 3/2007 | Choi | A47B 57/408 | 211/187 |
| 2009/0090686 | A1 * | 4/2009 | Collins | A47B 57/406 | 211/186 |
| 2010/0079042 | A1 * | 4/2010 | Eilers | A47B 47/05 | 312/107 |
| 2012/0000873 | A1 * | 1/2012 | Fitzgerald | A47B 96/1441 | 211/153 |
| 2013/0205685 | A1 * | 8/2013 | Leatherman | E04H 1/1266 | 52/79.1 |
| 2015/0282613 | A1 * | 10/2015 | Chen | A47B 96/021 | 211/187 |
| 2015/0313357 | A1 * | 11/2015 | David | A47B 47/027 | 211/187 |
| 2015/0342342 | A1 * | 12/2015 | Hu | A47B 55/00 | 211/186 |
| 2016/0051044 | A1 * | 2/2016 | Sabounjian | A47B 47/021 | 211/186 |
| 2017/0238710 | A1 * | 8/2017 | Tsai | A47B 57/34 | |
| 2017/0280875 | A1 * | 10/2017 | Buckley | A47B 57/34 | |
| 2019/0125077 | A1 * | 5/2019 | Liss | A47B 96/021 | |
| 2019/0328134 | A1 * | 10/2019 | Walker | A47B 96/1408 | |

FOREIGN PATENT DOCUMENTS

| | | | | | |
|---|---|---|---|---|---|
| DE | 3109187 | A1 * | 2/1982 | | |
| DE | 9312847 | U1 * | 2/1994 | | |
| DE | 102006001516 | A1 * | 7/2007 | A47B 57/402 | |
| DE | 102006004046 | A1 * | 8/2007 | A47B 47/021 | |
| DE | 102006007357 | A1 * | 8/2007 | A47B 47/021 | |
| DE | 102007002064 | A1 * | 7/2008 | A47B 47/05 | |
| EP | 1129644 | A1 * | 9/2001 | A47B 57/50 | |
| EP | 1358820 | A2 * | 11/2003 | A47B 57/406 | |
| EP | 1776895 | A1 * | 4/2007 | A47B 47/005 | |
| EP | E P-2661984 | A1 * | 11/2013 | A47B 3/06 | |
| FR | 1462480 | A * | 4/1966 | | |
| FR | 2069061 | A5 * | 9/1971 | | |
| FR | 2079763 | A5 * | 11/1971 | | |
| GB | 191113141 | A * | 10/1911 | | |
| GB | 455063 | A * | 10/1936 | | |
| GB | 613256 | A * | 11/1948 | | |
| WO | WO-03015579 | A1 * | 2/2003 | A47B 57/402 | |

* cited by examiner

ENCLOSURE ASSEMBLY SYSTEM

I. FIELD OF THE INVENTION

Generally, an enclosure and method for assembling an enclosure including a plurality of frame members connected or interconnectable to generate a framework and a plurality of panels fastened or fastenable to the framework. In particular embodiments, enclosure and a method of assembling an enclosure from a kit including prefabricated enclosure sides including interconnectable frameworks fastened to panels configured to overlap adjacent panel edges at the corners upon interconnecting the frameworks.

II. BACKGROUND OF THE INVENTION

Packaging and transportation of preassembled enclosures to support countertops, cooktops, grills, sinks, or other accessories can be expensive due to the shipping and handling costs associated with transport of enclosures which are entirely assembled. Accordingly, the inventive enclosures include separate components of the enclosure which upon arrival at the destination can be readily assembled in situ. There would be a substantial advantage in enclosure and a method of assembling an enclosure in-situ from a kit including a plurality of frame members interconnectable to provide a framework on which prefabricated panels can be readily fastened or including prefabricated enclosure sides including interconnectable frameworks fastened to panels configured to overlap adjacent panel edges at the corners to generate an enclosure.

II. SUMMARY OF THE INVENTION

A broad object of particular embodiments of the invention can be to provide a framework and a method of assembling a framework including a plurality of rectangular tubular members each having tubular member length disposed between tubular member first and second open ends and having an apertured fitting disposed in one or more of the tubular member sides and a plurality of angled members each having a pair of angled member end pieces having an end piece aperture alignable with the apertured fittings disposed in the plurality rectangular tubular members to receive a mechanical fastener to secure the plurality of angled members to the plurality of rectangular tubular members to generate the framework.

Another broad object of particular embodiments of the invention can be to provide prefabricated first and second enclosure sides and methods of assembling the first and second enclosure sides to afford an enclosure, wherein the first enclosure side includes a pair of rectangular tubular members each having a pair of apertured fitting disposed in a pair of adjacent tubular member sides at each tubular member end and a pair of angled members each having a pair of angled member end pieces joined at opposite angled member ends with each angled member end piece having an aperture, wherein the end piece apertures of the first of the pair of angled members correspondingly aligned with the apertured fittings disposed proximate the first ends of the pair or rectangular tubular members, wherein the end piece apertures of the second of the pair of angled members correspondingly aligned with the apertured fittings disposed proximate the second ends of the pair of rectangular tubular members to receive mechanical fasteners to secure the pair of angled members to said pair of rectangular tubes and a first panel fastened to said pair of angled members joined to said pair of rectangular tubes and extending to a first enclosure side periphery, and wherein the second enclosure side includes a second pair of angled members each having a pair of angled member end pieces joined to opposite angled member first and second ends with each angled member end piece having an endpiece aperture and a second panel fastened to the second pair of angled members, whereby the second pair of angled members fastened to said second panel correspondingly align the endpiece apertures with the apertured fittings disposed proximate opposite first and second ends of the pair of rectangular tubular members, and wherein the second panel fastened to the second pair of angled members extends beyond the second pair of angled members to abut said first panel of the first enclosure side in an enclosure corner upon, wherein mechanical fasteners received in the endpiece apertures and apertured fittings secure the second enclosure side to the first enclosure side to generate an enclosure.

Another broad object of particular embodiments of the invention can be to provide prefabricated first and second enclosure sides and methods of assembling the first and second enclosure sides to afford an enclosure, wherein the first enclosure side, includes a first pair of angled members and a pair angled member end pieces joined proximate first and second ends of each of said first pair of angled members with each angled member end piece having an aperture and a second pair of angled members with a first of said second pair of angle members having first and second ends corresponding joined to first ends of said first pair of angled members and with a second of said second pair of angled members having first and second ends corresponding joined to second ends of said first pair of angled members, wherein an outer face of each of the second pair of steel angles disposed generally flush with an outer face of the first pair of steel angles to generate an enclosure first side frame, and a first panel fastened to and extending beyond the second pair of angled members of the enclosure first side frame, and wherein the second enclosure side includes a plurality of rectangular tubes each having a first open end opposite a second open end and having a first side opposite a second side with the first side having an apertured fitting adapted to matingly receive a fastener, one of the rectangular tubes disposed at each corner of a second enclosure side and a plurality of angled members with one of the plurality of steel angles having opposite ends correspondingly joined to adjacent pairs of the tubular rectangular corner pieces with an outer face disposed generally flush with the second side of the rectangular tube to generate an enclosure second side frame and a second panel fastened to and extending to the periphery of the enclosure second side frame, whereby the endpiece apertures of the first side frame align with the apertured fittings disposed the pair of rectangular tubes and mechanical fasteners received in the endpiece apertures and apertured fittings secure the first enclosure side to the second enclosure side to generate an enclosure.

Naturally, further objects of the invention are disclosed throughout other areas of the specification, drawings, photographs, and claims.

IV. BRIEF DESCRIPTION OF THE DRAWINGS

Figure 8:
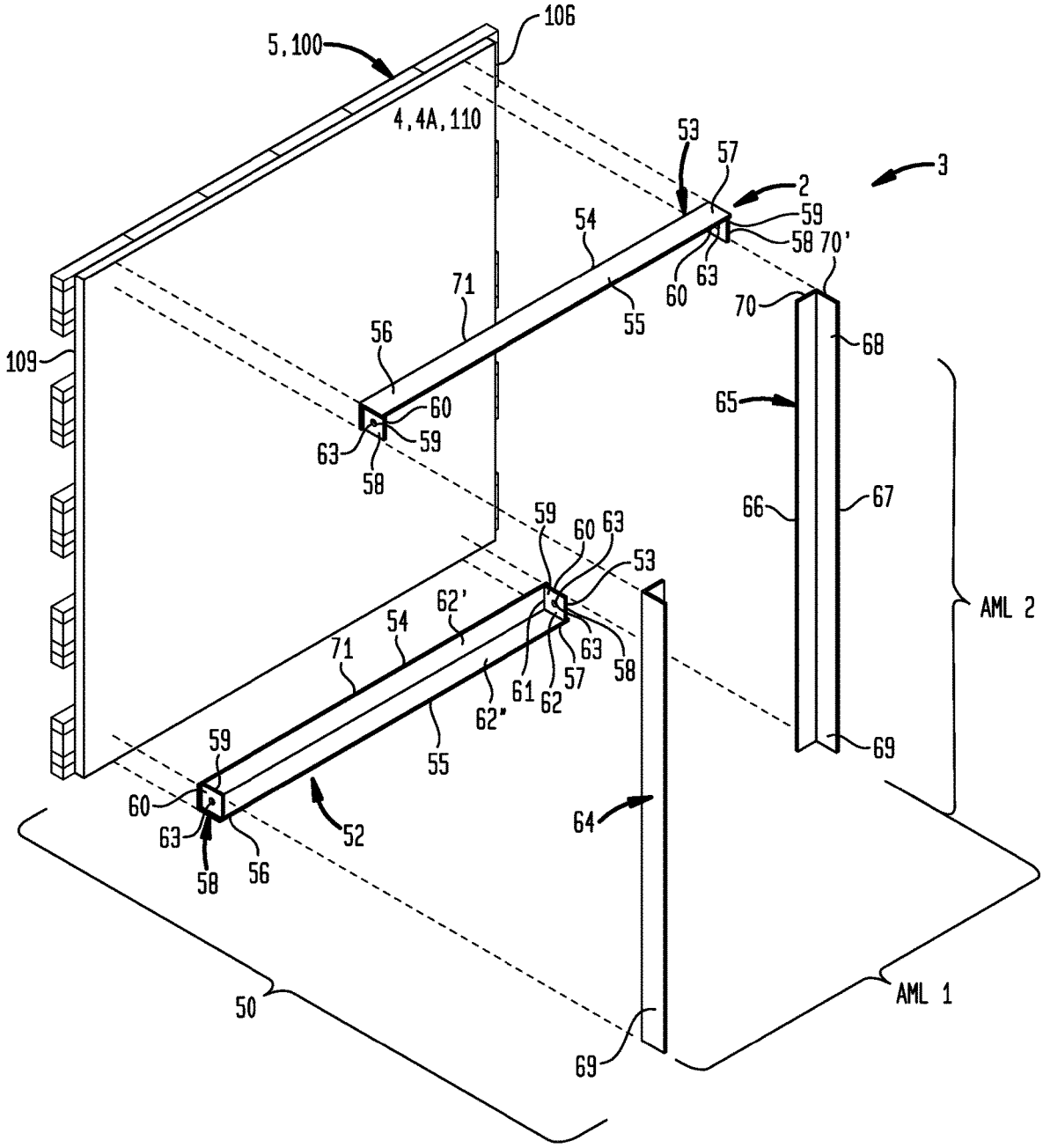
FIG. 8 is an exploded view of an enclosure first side panel of a particular embodiment of an enclosure.
Figure 9A:
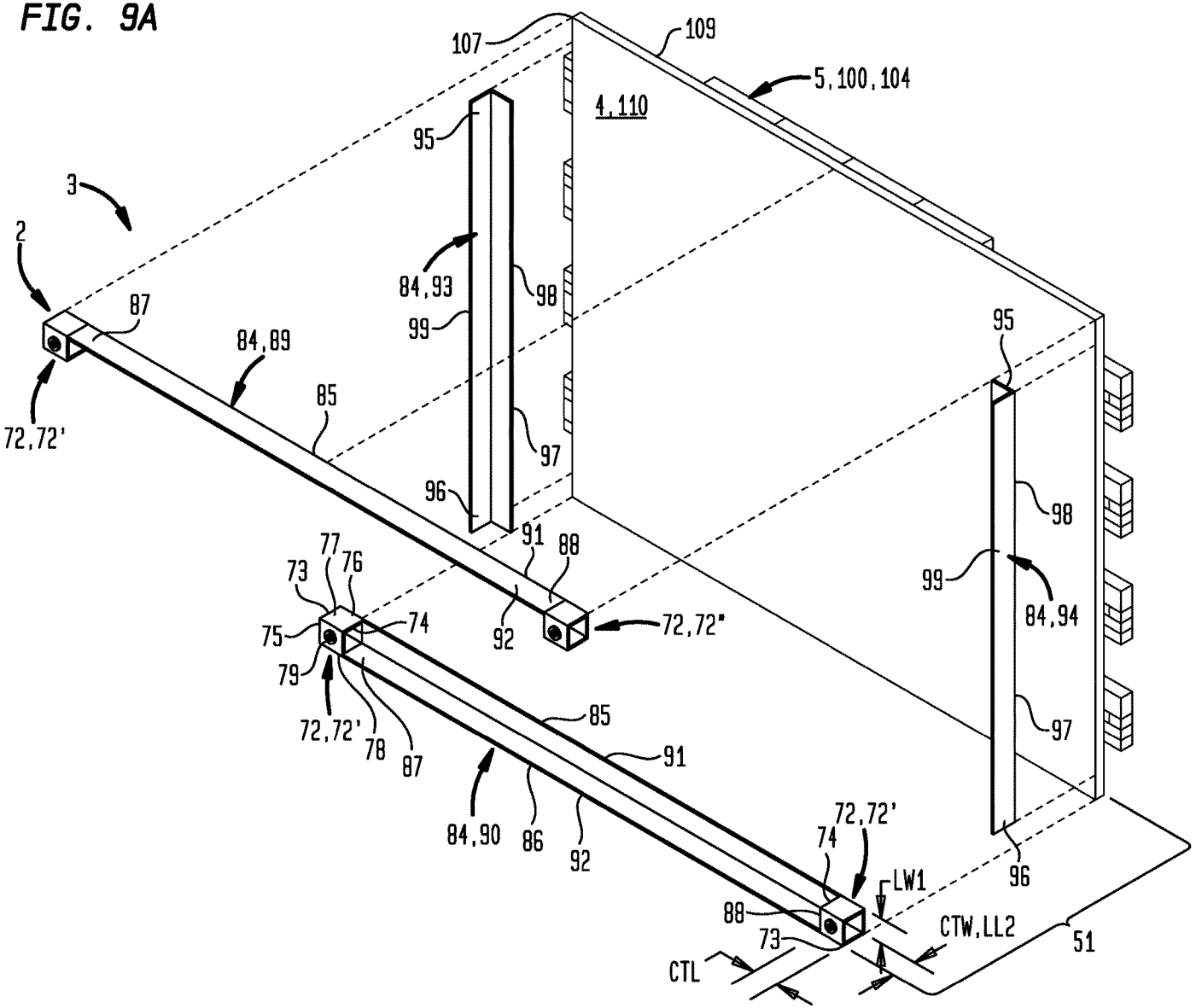
FIG. 9A is an exploded view of an enclosure second side panel of a particular embodiment of an enclosure which can be joined to the enclosure first side panel depicted in FIG. 8.
Figure 9B:
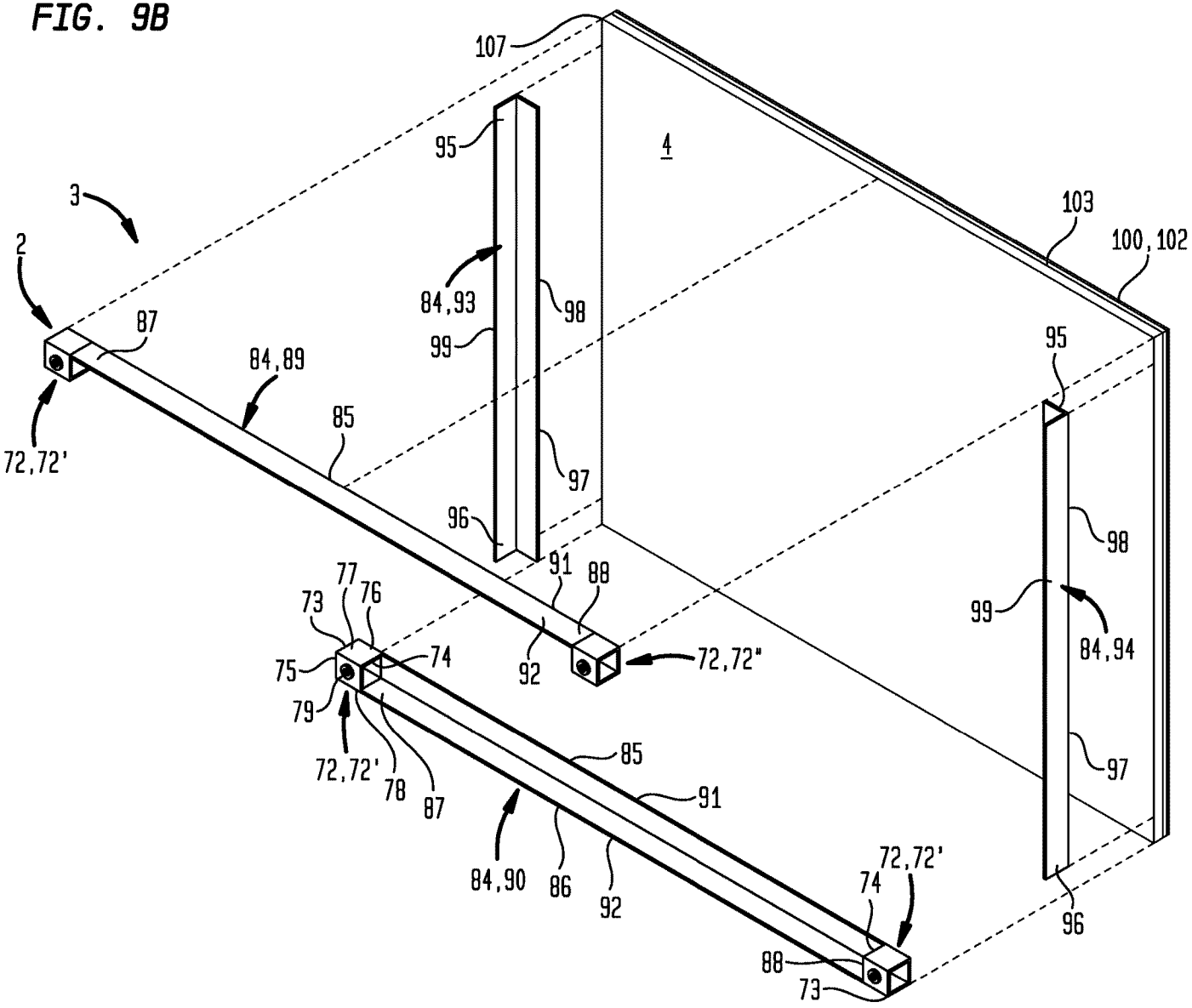

FIG. 9B exploded view of an enclosure second side panel of a particular embodiment of an enclosure which can be joined to the enclosure first side panel depicted in FIG. 8 having an optional finish layer which can be utilized on the first side panel or second side panel.

Figure 10:
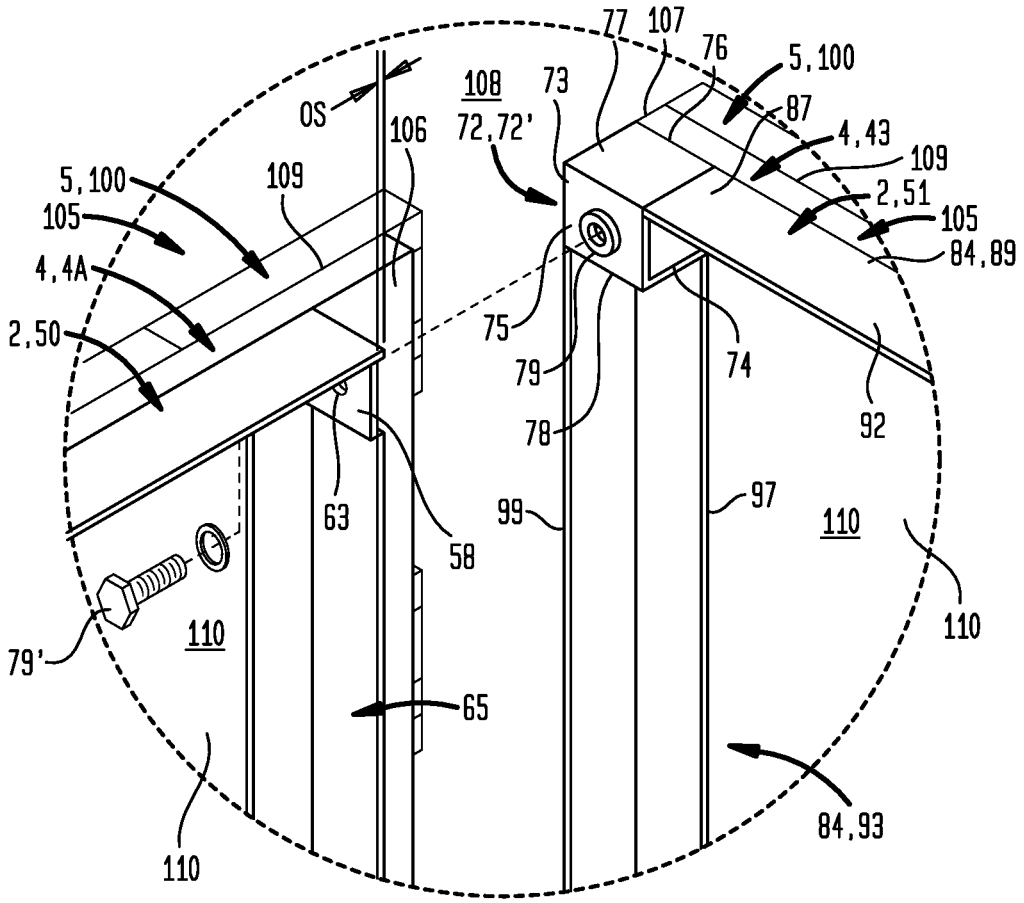

FIG. 10 is an exploded isometric view of an enclosure including the enclosure first side panel depicted in FIG. 8 joined to the enclosure second side panel depicted in FIG. 9, and further illustrating a particular embodiment of a finish layer optionally affixed in part or in whole to the exterior surface of the enclosure first and second side panels.

Figure 2:
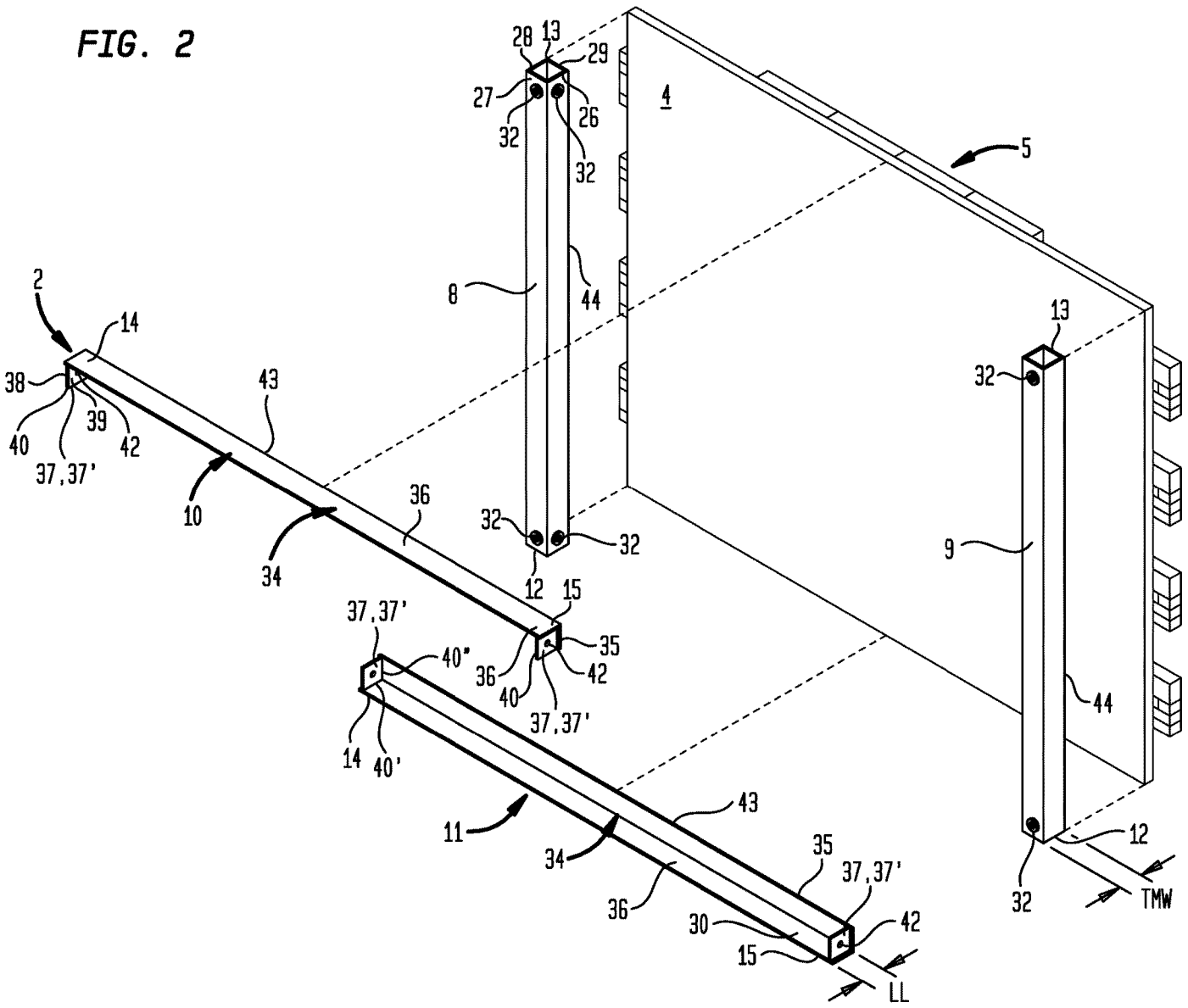
FIG. 2 is an exploded view of an enclosure first side panel of a particular embodiment of an enclosure.
Figure 3:
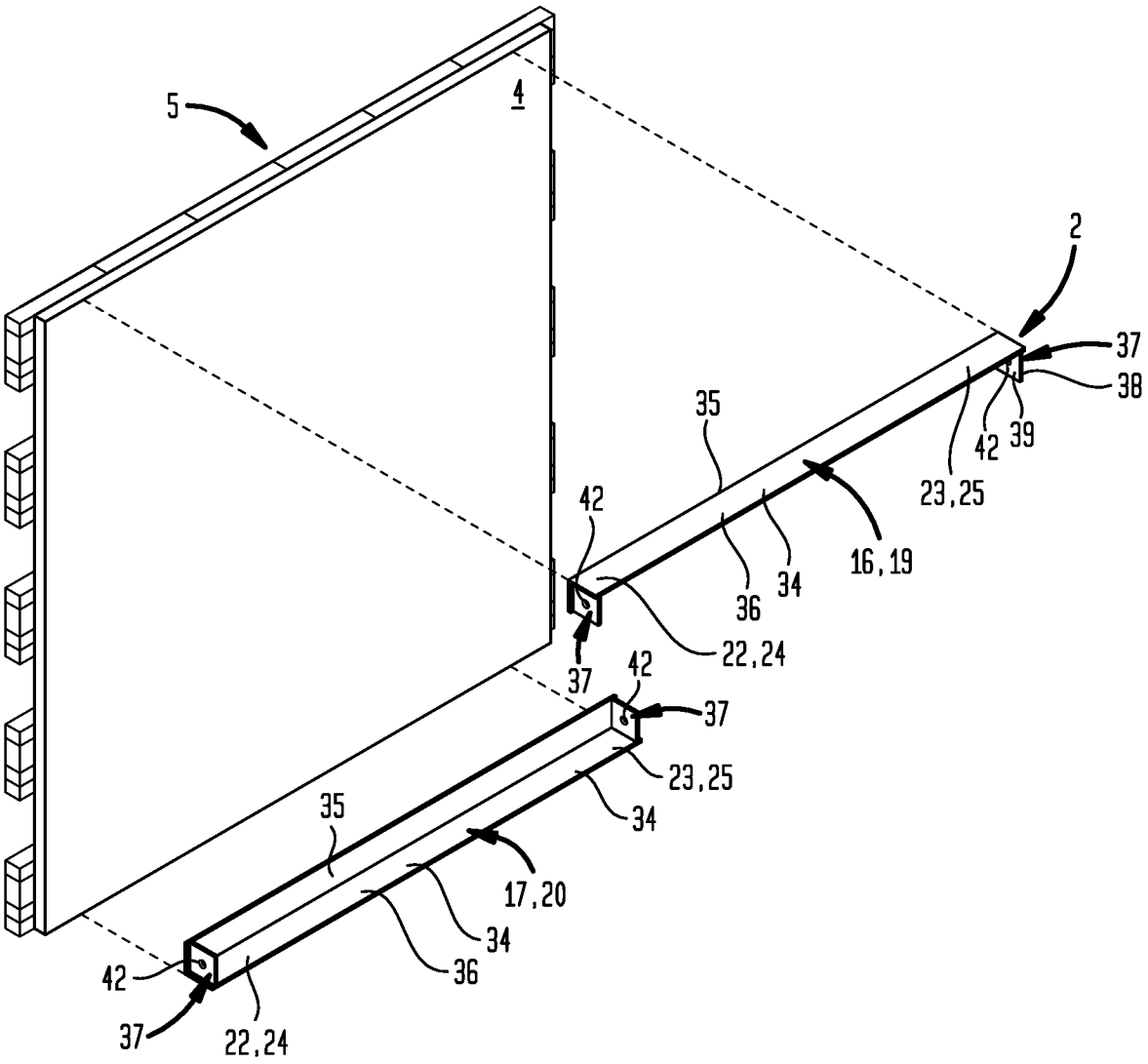
FIG. 3 is an exploded view of an enclosure second side panel of a particular embodiment of an enclosure which can be joined to the enclosure first side panel depicted in FIG. 2.
Figure 4:
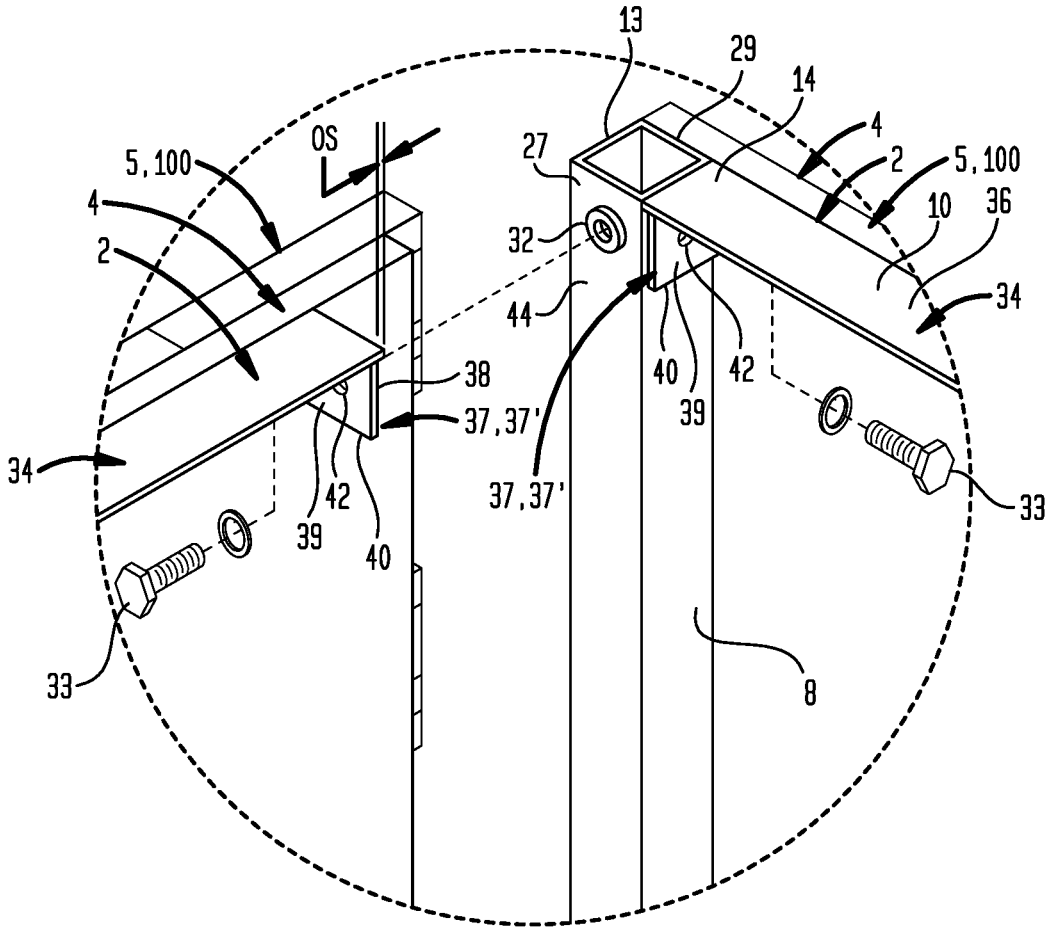
FIG. 4 is an exploded isometric view of an enclosure including the enclosure first side panel depicted in FIG. 2 joined to the enclosure second side panel depicted in FIG. 3, and further illustrating a particular embodiment of a finish layer optionally affixed in part or in whole to the exterior surface of the enclosure first and second side panels.
Figure 11:
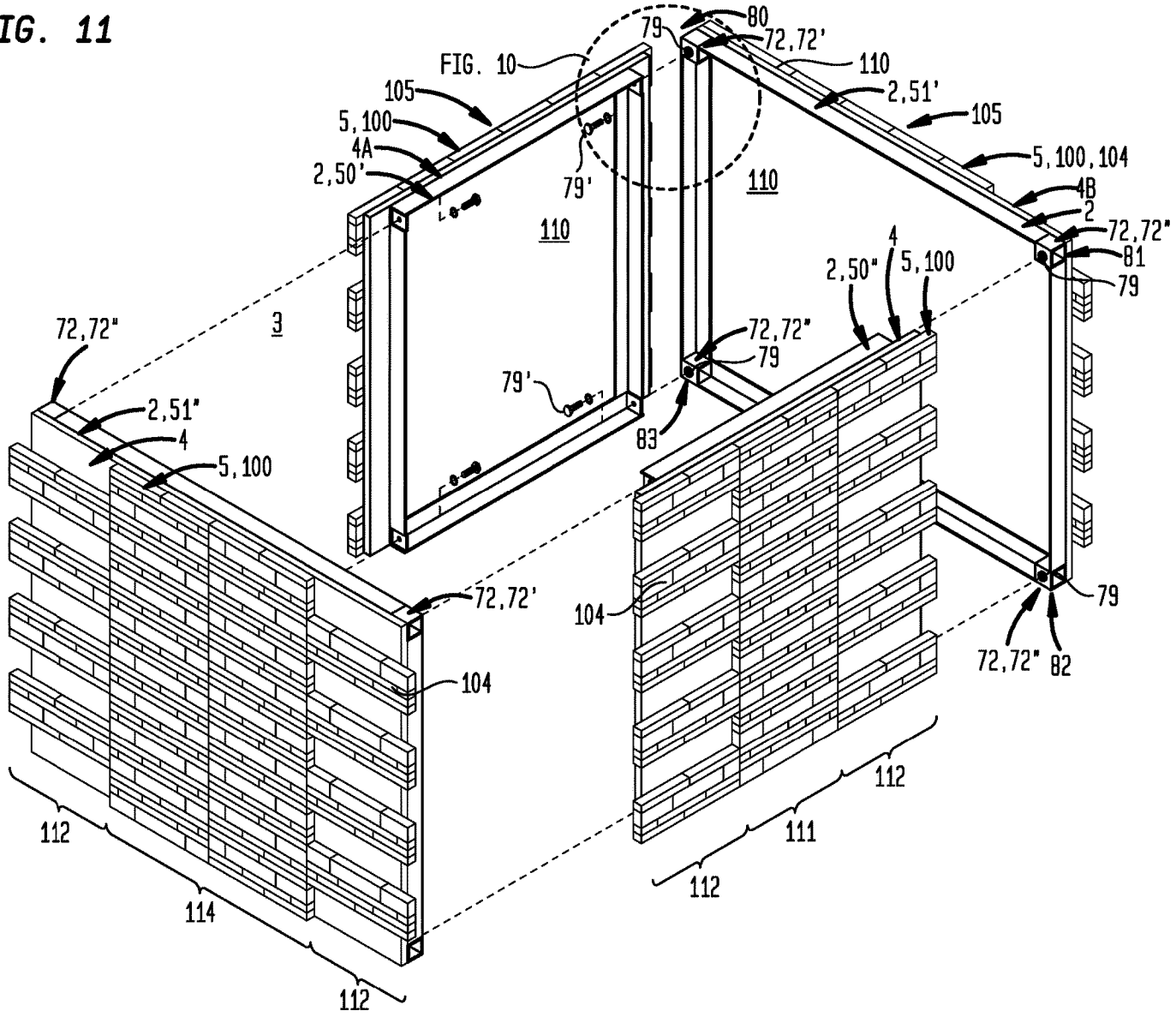

FIG. 11 is an enlarged portion of FIG. 4 illustrating assembly of the enclosure first side panel depicted in FIG. 2 to the enclosure second side panel depicted in FIG. 3.

Figure 12:
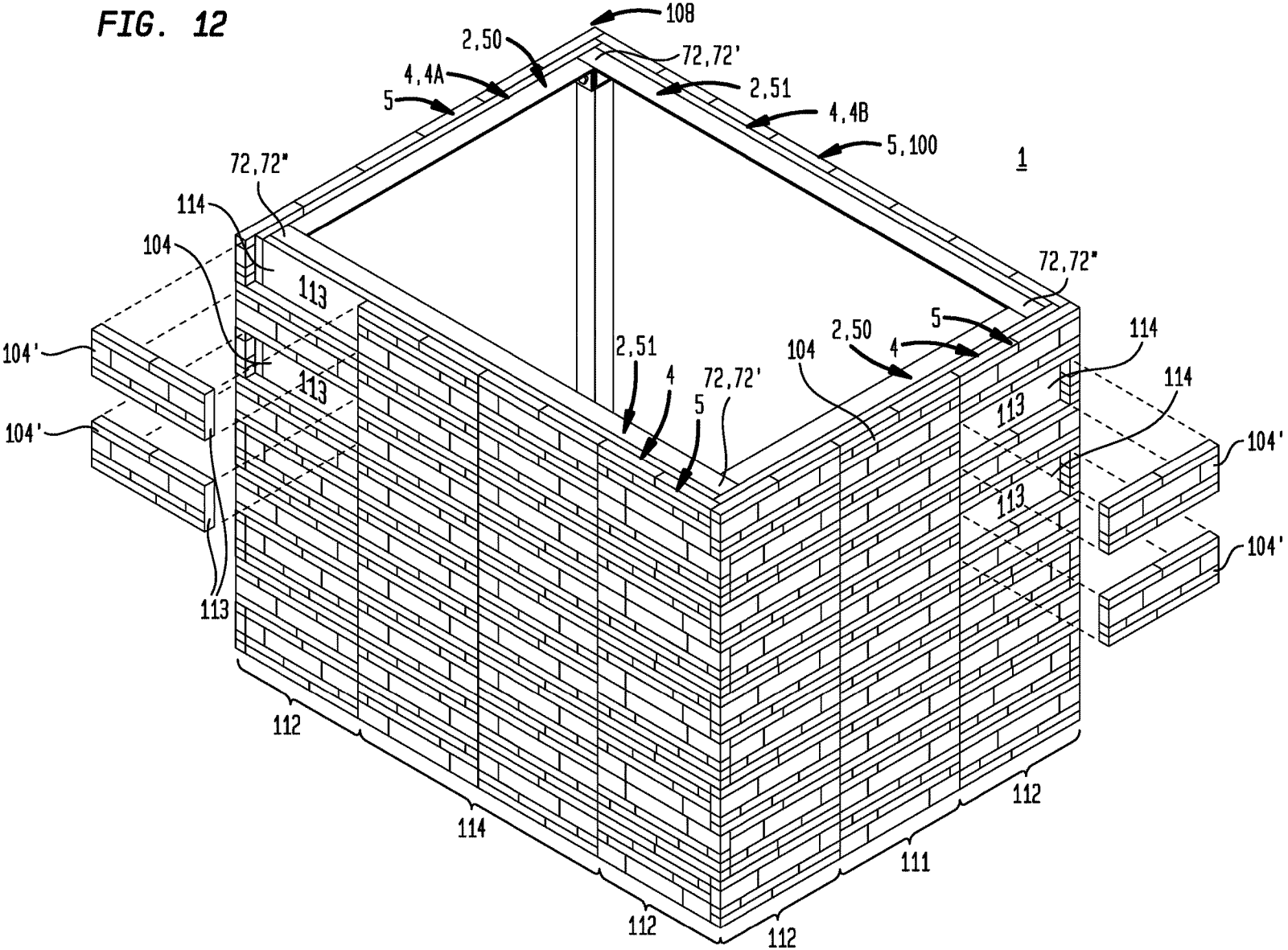

FIG. 12 is an illustration of an embodiment of an enclosure assembled from a pair of the first side panels depicted in FIG. 8 and a pair of the enclosure second side panel depicted in FIG. 9 and further depicting a finish layer optionally affixed in part after assembly of the enclosure first side panel depicted in FIG. 2 to the enclosure second side panel depicted in FIG. 3.

V DETAILED DESCRIPTION OF THE INVENTION

Now, with general reference to FIGS. 1 through 14, and further described herein, are particular embodiments of an enclosure (1), and a kit and method for assembling an enclosure (1), including one or more of: a plurality of frame members (2) interconnected or interconnectable to generate a framework (3) and a plurality of panels (4) connected or connectable to the framework (3), and optionally, a finish layer (5) affixed or affixable to the plurality of panels (4).

Figure 1:
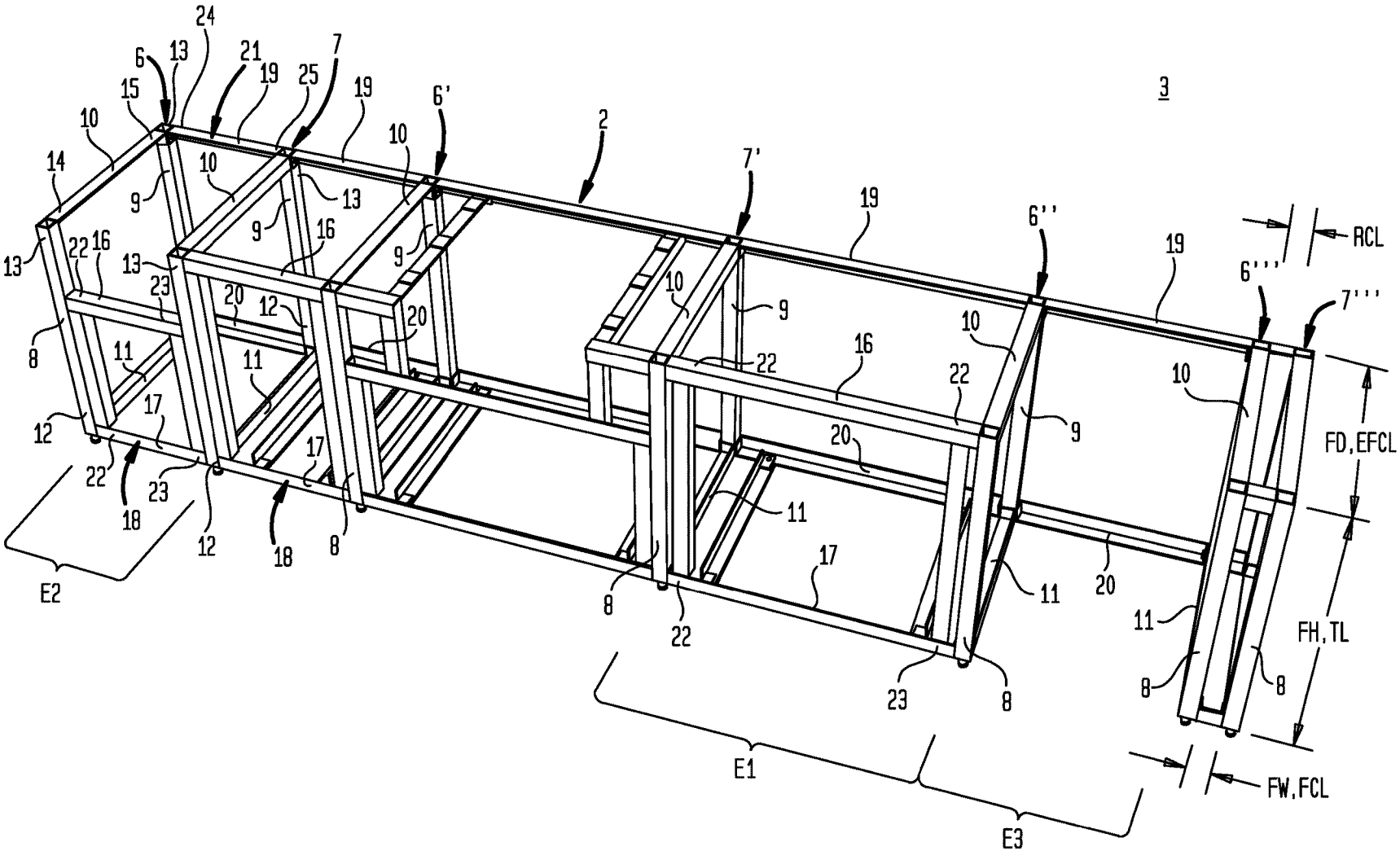
FIG. 1 is an illustration of a framework in accordance with a particular embodiment of the invention.

Now, with primary reference to FIG. 1, as a first illustrative example, embodiments of the framework (3) can be assembled by interconnecting a plurality of frame members (2). In the illustrative embodiment shown in the Figures, the plurality of frame members (2) can comprise or consist of a first end frame (6)(6')(6") and a second end frame (7)(7')(7"), each of the first and second end frames (6)(7) can include front and rear upright tubular members (8)(9) interconnected by an end frame top cross member (10) disposed opposite an end frame bottom cross member (11). In the illustrative examples, the front and rear upright tubular members (8)(9) have a generally vertical orientation, while the end frame top and bottom cross members (10)(11) have a generally horizontal orientation; provided that, the assembled framework (3) in which the front and rear upright tubular members (8)(9) and the end frame top and bottom frame members (10)(11) have a fixed spatial arrangement and can be disposed in any orientation and the terms front, rear, top, and bottom are used solely to aid a person of ordinary skill in the art in understanding the structural relationship between the elements of the invention.

Again, with primary reference to FIG. 1, as an illustrative example, the first and second upright tubular members (8)(9) can comprise aluminum square tube two inch by two inch outside dimensions with a one-eighth inch wall; however, this illustrative example is not intended to preclude embodiments using square tube or rectangular tube having greater or lesser dimensions depending on the application or made from iron, stainless steel, or lightweight non-ferrous metals, or optionally can be made from plastic including as illustrative examples polyethylene, polypropylene, butadiene styrene. polystyrene, polylactic acid, and combinations thereof. The first and second tubular members (8)(9) can each have a tube length (TL) disposed between tubular upright member first and second ends (12)(13), wherein the tube length (TL) can establish a framework height (FH). In particular embodiments the first and second tubular members (8)(8) can, but need not necessary, be different in tube length (TL).

Again, with primary reference to FIG. 1, in the illustrative example, the first and second end frames (6)(7) each include end frame top and bottom crossmembers (10)(11); however, this is not intended to preclude a greater number of end frame cross members interconnected between the first and second upright tubular members (8)(9). Additionally, while the top and bottom crossmembers (10)(11) may be depicted as being correspondingly disposed proximate opposite tubular member first and second ends (12)(13), this is not intended to preclude embodiments in which either one of the end frame top and bottom crossmembers is disposed medially between tubular member first and second ends (12)(13). The end frame top cross member (10) and the end frame bottom cross member (11) can each have an end frame crossmember length (EFCL) disposed between cross member first and second ends (14)(15), wherein the crossmember length (EFCL) can establish the framework depth (FD). In particular embodiments, the end frame top cross member (10) and the end frame bottom cross member (11) can, but need not necessarily, have substantially the same or the same crossmember length (EFCL), while particular embodiments may utilize different end frame cross member lengths (EFCL).

Again, with primary reference to FIG. 1, the first and second end frame (6)(7) front upright members (8) can be interconnected by a top front cross member (16) proximate first and second end frame (6)(7) front upright tubular member second ends (13) and a bottom front cross member (17) proximate first and second end frame front upright member first ends (12) defining an enclosure front frame (18). Correspondingly, the first and second end frame (6)(7) rear upright members (9) can be interconnected by a top rear cross member (19) proximate first and second end frame (6)(7) rear upright member second ends (13) and a bottom rear cross member (20) proximate first and second end frame rear upright member second ends (13) defining an enclosure rear frame (21). The top and bottom front cross members (16)(17) can each have a front crossmember length (FCL) correspondingly disposed between top and bottom front cross member first and second ends (22)(23). The top and bottom rear cross members (19)(20) can each have a crossmember length (RCL) correspondingly disposed between top and bottom rear cross member first and second ends (24)(25), wherein front and rear cross member length (FCL)(RCL) can establish the framework width (FW). In particular embodiments the top and bottom front and rear cross members (16)(17)(19)(20) can have substantially the same, the same, or different in cross member lengths (FCL)(RCL).

While the illustrative example shown in the FIG. 1, provides several examples of the front and rear top and bottom crossmembers (16)(17)(19)(20) having opposite front and rear crossmember first and second ends (22)(23)(24)(25) correspondingly disposed proximate the front and rear upright tubular members (8)(9) first and second ends (12)(13) of the first and second end frame (6)(7) (as shown in example E1); the illustrative examples also depict embodiments having the top front cross member (16) having opposite ends (22)(23) correspondingly disposed medially on the front upright tubular members (8) of the first and second end frames (6)(7) (as shown in example E2), and also depict embodiments in which the top and bottom front cross members (16)(17) are entirely lacking (example E3). Also, the illustrative examples depict embodiments in which a plurality of end frames (6)(7)(6')(7')(6")(7")(6''')(7''') can be interconnected in various linear and angled frameworks (3) by connecting the crossmembers to any of the four faces (26)(27)(28)(29) of the upright tubular members (8)(9) (as shown in the example FIG. 2). Additionally, while the Figures depict embodiments of assembled frameworks (3) defining generally rectangular frameworks; these illustrative examples are not intended to preclude embodiments of a framework (3) defining any polygonal structure, such as: triangle, square, rectangle, pentagon, hexagon, or combinations thereof. Moreover, these illustrative examples are not intended to depict all the possible configurations possible, but rather, are intended to provide a sufficient number of examples to allow the person of ordinary skill to make and use any of a numerous and wide variety of enclosure (1) configurations.

Again, with primary reference to FIG. 1, the upright tubular members (8) (9) having a tubular member first end (12) opposite a tubular member second end (13) (as shown in the illustrative examples of FIGS. 1 through 6 as having a first open end opposite a second open end) can have an apertured fitting (32) disposed proximate the first or second end (12)(13) adapted to matingly receive a mechanical fastener (33) (as shown ink the example of FIG. 4). In particular embodiments, as depicted by the first end frame (6) of example E1, apertured fittings (32) can be disposed in a pair of adjacent faces (26)(27) of the upright tubular member (9), while in particular embodiments as depicted by Example E2, apertured fittings (32) can be disposed in three adjacent faces (26)(27)(28) of the upright tubular member (9). These illustrative examples are not intended to preclude embodiments in which apertured fittings can be disposed in all four faces (26)(27)(28)(29) of an upright tubular member (8)(9) to allow assembly of a numerous and wide variety of configurations of enclosures (1).

Now, with general reference to FIG. 1 and with primary reference to FIGS. 2 through 6, the crossmembers (10)(11)(16)(17)(19)(20) can be of similar construction including an angle member (34) having a first leg (35) generally orthogonally joined to a second leg (36) and having a length disposed between opposite crossmember first and second ends (14)(15). The first and second legs (35)(36) can, but need not necessarily, have a leg length (LL) of equal or substantially equal length. In particular embodiments, the leg length (LL) can be generally equal to the upright tubular member width (TMW) of the upright tubular members (8)(9)(as shown in the example of FIG. 2). For example, if the upright tubular members (8)(9) have a two inch wide sides (TMW), the first leg (35) and the second leg (36) of the angle member (34) can be two inches; however, the illustrative examples described and depicted in the Figures are not intended to preclude the use of angle member(s)(34) which have a greater or lesser leg length (LL) then the tubular member width (TMW) of the upright tubular members (8)(9). The angle member (34) which can be made from steel, and typically made of aluminum, can optionally, be made of iron, stainless steel, or other lightweight nonferrous metals, or optionally can be made from plastic including as illustrative examples polyethylene, polypropylene, butadiene styrene. polystyrene, polylactic acid, and combinations thereof.

Again, with general reference to FIG. 1 and primary reference to FIGS. 2 through 6, a cross member end piece (37) can be disposed at the first end (14) or the second end (15), or both the first and second ends (14)(15), of each angle member (34). The crossmember end pieces (37) can have opposite end piece faces (38)(39) extending to end piece edges (40) joined to a leg inner face (41) of the first or second legs (35)(36) of the angle member (34) to allow one of the end piece faces (38)(39) to be disposed proximate or flush with a corresponding one of the first or second ends (14)(15) of the angle member (34). Each cross member end piece (37) can have an end piece aperture (42) communicating between opposite end piece faces (38)(39). The end piece aperture (42) can be disposed to align with the apertured fitting (32) disposed proximate the first or second end (30)(31) of a corresponding upright tubular member (8)(9) to allow a mechanical fastener (33) to pass through the end piece aperture (42) and matingly engage the apertured fitting (32) disposed in the upright tubular member (8)(9), whereby the first or second ends (14)(15) of the angle member (34) can be secured in fixed spatial relation to the upright tubular member (8)(9). The end piece aperture (42) can, but need not necessarily, be configured to allow movement in relation to the mechanical fastener (33) to allow adjustable spatial relation of the first or second crossmember end (14)(15) to allow the leg outer face (43) of the first or second legs (35)(36) of the angle member (34) to be aligned with the tubular member outer face (44) and the tubular member first or second ends (12)(13) of the upright tubular member (8)(9) to provide a generally flat surface between the tubular member outer face (44)(in the example of FIGS. 2 and 4 face (29)) or tubular member first or second ends (12)(13) of the upright tubular (8)(9) and the leg outer face (43) of the first or second leg (35)(36) of the angled crossmember (34).

In the illustrative example of FIGS. 2 through 5, the cross member end pieces (37) comprise a pair rectangular end pieces (37') each having flat opposite end piece faces (38)(39) extending to end piece edges (40) and each including an end piece aperture (42) communicating between the opposite end piece faces (38)(39). One of the pair of rectangular end pieces (37') can be disposed at the first end (14) and the second end (15) of the angled member (34) with each rectangular end piece (37) having a first pair of adjacent end piece edges (40')(40") correspondingly orthogonally joined to a leg inner face (41) of the first and second legs (35)(36)

to dispose one of the flat end piece faces (38)(39) flush with a corresponding one of said first or second ends (14)(15) of the angled member (34). The end piece aperture (42) can be aligned with the apertured fitting (32) disposed proximate the first or second end (30)(31) of a corresponding upright tubular member (8)(9) to allow a mechanical fastener (33) to pass through the end piece aperture (42) and matingly engage the apertured fitting (32) disposed in the upright tubular member (8)(9), as above described.

Now, with primary reference to FIG. 4, in particular embodiments, the apertured fitting (32) disposed proximate the first or second end (12)(13) of a corresponding upright tubular member (8)(9) may not be flush with the tubular member face (44) of the upright tubular member (8)(9). As to these embodiments, the crossmember end pieces (37) can be offset (OS) in relation to the corresponding crossmember end (14)(15) to allow the offset (OS) to receive the apertured fitting (32) and to allow the crossmember end (14)(15) upon being disposed in fixed spatial relation to the upright tubular member (8)(9) to abut the tubular member outer face (44) to provide a generally continuously flat surface between the tubular member outer face (44) of the upright vertical member (8)(9) and the leg outer face (43) of the first or second leg (35)(36) of the angled member (34).

Now, with general reference to FIGS. 7 through 11, as a second illustrative example, embodiments of the enclosure (1) can include a framework (3) assembled by mechanically fastening a first rectangular frame (50) to a second rectangular frame (51). With primary reference to FIG. 8, the first rectangular frame (50) can comprise or consist of a first pair of angled members (52)(53) each including a first leg (54) generally orthogonally joined to a second leg (55) and having an angled member length (AML1) disposed between opposite angle member first and second ends (56)(57). An angled member end piece (58) can be disposed at the angled member first end (56) or the angled member second end (57), or both the first and second ends (56)(57), of each of the first pair of angle members (52)(53) of the first pair of angle members (52)(53). The angled member end pieces (58) can have opposite end piece faces (59)(60) extending to adjacent end piece edges (61)(62) joined to a corresponding leg inner face (62')(62") of the first or second legs (54)(55) of the of a corresponding one of the first pair of angle members (52)(53) to allow one of the end piece faces (59)(60) to be disposed proximate or flush with a corresponding one of the angular member first or second ends (56)(57) of a corresponding one of the first pair of angle members (52)(53). Each angled member end piece (58) can have an end piece aperture (63) communicating between opposite end piece faces (59)(60).

In the illustrative example of FIG. 8, the angled member end pieces (58) can comprise rectangular end pieces (58) each having opposite flat end pieces faces (59)(60) extending to end piece edges (61)(62) and an end piece aperture (63) communicating between the opposite flat end piece faces (59)(60). One the rectangular end pieces (58) can be disposed at each of an angled member first end (56) and an angled member second end (57) of a corresponding one of the first pair of angled members (52)(53) with each rectangular end piece (58) having a first pair of adjacent end piece edges (40')(40") correspondingly orthogonally joined to an inner face (62')(62") of the first and second legs (54)(55) to dispose one of the opposite flat end piece faces (59)(60) proximate or flush with a corresponding one of the angled member first or second ends (56)(57) of the first pair of angled members (52)(53).

Again, with general reference to FIGS. 7 through 11 and in particular FIG. 8, the first rectangular frame (50) can further comprise or consist of a second pair of angled members (64)(65) having a first leg (66) generally orthogonally joined to a second leg (67) and having an angled member length (AML2) disposed between opposite angled member first and second ends (68)(69). A first of the second pair of angled members (64) having angled member first and second ends (68)(69) correspondingly joined in fixed spatial orthogonal relation to the first ends (56) of the first pair of angle members (52)(53), and a second of the second pair of angled members (65) having angled member first and second ends (68)(69) can be correspondingly joined in fixed spatial orthogonal relation to the second ends (57) of the first pair of angled members (52)(53), whereby the leg outer face (70) of the first leg (66) of each of the second pair of angled members (64)(65) can be disposed in spatial relation with a leg outer face (71) of the first leg (54) of the first pair of angled members (52)(53) to form a generally flat continuous surface, and whereby a leg outer face (70') of the second leg (67) of each of said second pair of angled members (64)(65) can be disposed in generally orthogonal relation to the outer face (71) of the first leg (54) of each of the first pair of angled members (52)(53) and in generally parallel relation to the end piece face (60) of the corresponding one of the angle member end pieces (58) joined to the angled member first or second end (56)(57) of each of the first pair of angled members (52)(53).

Now, with general reference to FIGS. 7 through 12 and particular reference to FIG. 9A, the second rectangular frame (51) can comprise or consist of rectangular corner tubes (72) having a length (CTL) disposed between a corner tube first end (73) opposite a corner tube second end (74) (in the illustrative examples each corner tube having a corner tube open first end and a corner tube open second end) and having a corner tube first side (75) opposite a corner tube second side (76) and a corner tube third side (77) opposite a corner tube fourth side (78), wherein the corner tube first side (74) includes a corner tube apertured fitting (79) adapted to matingly receive a mechanical fastener (79'). One of the rectangular corner tubes (72) can be disposed at each corner (80)(81)(82)(83) of the second rectangular frame (51)(as shown in the example of FIG. 11. A plurality of angled members (84) each having a first leg (85) generally orthogonally joined to a second leg (86) can have opposite angled member ends (87)(88) correspondingly joined in generally orthogonal relation to adjacent pairs of the tubular rectangular corner tubes (72') (72"). Each of a first pair (89)(90) of the plurality of angled members (84) can have opposite first and second angled member ends (87)(88) correspondingly joined to opposing second ends (74) of a pair of rectangular corner tubes (72), whereby the first leg (85) of the first pair of angled members (89)(90) has an leg outer face (91) disposed flush with the corner tube second side (76) of each rectangular corner tube (72), and the second leg (86) having an outer face (92) disposed flush with the corner tube fourth side (78) of the rectangular corner tube (72) and extending toward the corner tube first side (75) of the rectangular corner tube (72). Each of a second pair (93)(94) of the plurality of angled members (84) can have opposite member ends (95)(96) correspondingly joined to opposing corner tube fourth sides (78) of a pair of rectangular corner tubes (72')(72"), whereby, a first leg (97) of each of the second pair of angled members (93)(94) has an outer face (98) disposed flush with the corner tube second side (76) of the pair of rectangular corner tubes (72')(72"), and the second leg (98) having an outer face (99) disposed flush with the corner tube first end (73) of the rectangular corner tube (72) and extending toward the first side (75) of the rectangular corner tube (72).

Now with primary reference to FIG. 9, in particular embodiments, the corner tube length (CTL) and the corner tube side width (CTW) can be configured to generally match the first and second leg widths (LW1)(LW2) of the plurality of angled members (84) whereby the first and second legs (54)(55) of the plurality of angled members (84) joined to the rectangular corner tubes (72) do not extend beyond the corner tube length (CTL) and corner tube side width (CTW) of the rectangular corner tubes (72).

Now, with primary reference to FIGS. 10 through 11, a first rectangular frame (50) can be joined to a second rectangular frame (51) by aligning the end piece apertures (63) of the first rectangular frame (50) with the apertured fittings (79) disposed in the corner tube first side (75) of the rectangular corner tubes (72) to allow a mechanical fastener (79') to pass through the end piece apertures (63) and matingly engage the apertured fitting (79) disposed in the corner tube first side (75) of the rectangular corner tubes (72). As shown in the illustrative example of FIG. 11, a pair of first rectangular frames (50')(50") can be joined by mechanical fasteners (79') to a pair of second rectangular frames (51')(51") to assemble a framework (3) defining a rectangular volume (as shown in the example of FIG. 12) or interconnected in various rectangular volumes having a numerous and wide variety of framework lengths and widths which can be combined in various permutations and combinations to as shown in the illustrative example of FIG. 1.

Figure 5:
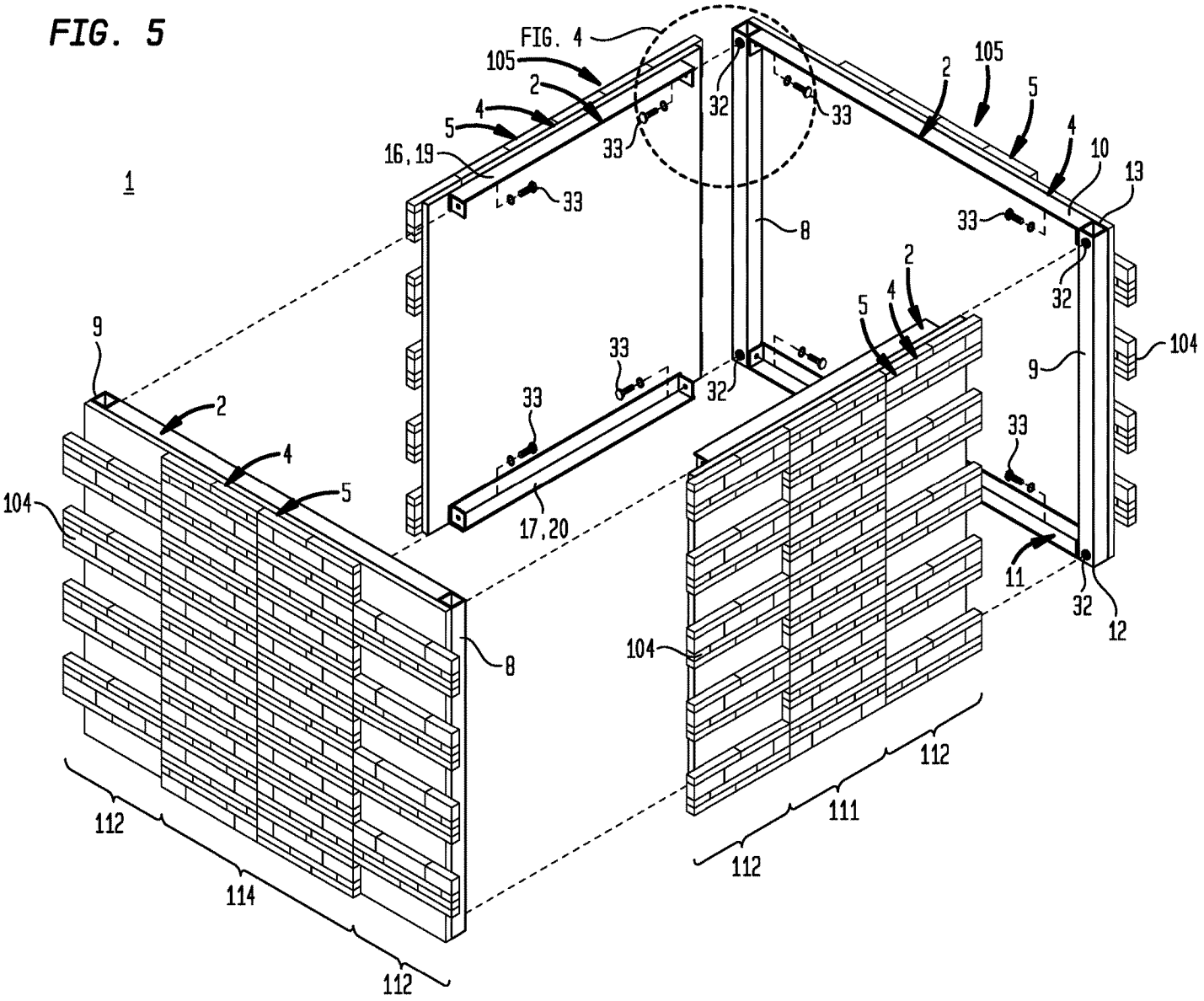
FIG. 5 is an enlarged portion of FIG. 4 illustrating assembly of the enclosure first side panel depicted in FIG. 2 to the enclosure second side panel depicted in FIG. 3.

Now, with general reference to FIGS. 1 through 12, embodiments can comprise, consist essentially of, or consist of one or more panels (4) affixed to framework (3). The panels (4) can further include a panel finish layer (5) which can comprise, consist essentially of, or consist of any one or combination of finish materials (100) including as illustrative examples, stone, ceramic, glass, concrete, wood, cork, brick, plastic, or laminates thereof where the finish material (101) can, but need not necessarily, comprise a thin finish layer (102) of the finish material (100) bonded to a support layer (103) to provide structural support for the thin finish layer (102)(as shown in FIG. 9B). In particular embodiments, the panel finish layer (5) can comprise masonry blocks (104). The term "masonry blocks" for the purposes of this invention broadly encompasses structural units that can be secured to a panel (4), and as illustrative examples, comprising or consisting of: metals, such as steel, stainless steel, aluminum, copper; stone, ceramic, quartz, porcelain, glass, concrete, wood, cork, brick, plastic, composites such as: DEKTON®, a composite of porcelain, glass and quartz, and combinations thereof. In particular embodiments, a plurality of masonry blocks (104) can be laid adjacent one another to cover the substantially the entirety or the entirety of the panel first side medial portion (105) of the panel (as shown in the example of FIGS. 5 and 11).

In the illustrative example of FIG. 11, a plurality of first rectangular frames (50) and a plurality of second rectangular frames (51) having affixed panels (4) with or without the finish layer (5) can be pre-fabricated as enclosure sides (105) which can be readily assembled in-situ to generate any of a numerous and wide variety of configurations of an enclosure (1). The pre-fabricated enclosure sides (105) of an enclosure (1) can be packaged together for transport as a kit which can be assembled in-situ in a relatively short period of time with unskilled labor which provides the substantial advantage of being both less expensive and time consumptive as compared to fabricating the enclosure in-situ stepwise by assembling a framework from separate pieces, affixing the panels to the framework and then affixing the finish layer to the panels. Additionally, because the pre-fabricated enclosure sides (105) have generally flat configuration, a plurality of enclosure sides (105) can be disposed in one flat-pack for transport.

Now, with primary reference to FIGS. 5 and 11, regardless of the configuration of the enclosure (1), upon joining a pair enclosure sides (105) the respective panels (4) can have adjacent panel edges (106)(107) disposed at an enclosure corner (108) of the enclosure (1). In the illustrative example of FIGS. 10 through 12, in a generally rectangular enclosure, the enclosure sides (105) can comprise a pair of panels (4A)(4B) connected to at least one first rectangular frame (50) and at least one second rectangular frame (51), whereby the panels (4A)(4B) have adjacent panel edges (106)(107) disposed at an enclosure corner (108) of the generally rectangular enclosure (1).

In particular embodiments, each of the panels (4A)(4B) include a panel first side (109) opposite a panel second side (110). The panels (4A)(4B) can be secured to the first or second rectangular frame (50)(51) abutting the panel second side (110) against the leg outer face (70) (71) of the first leg (54)(66) of the angled members (52)(53)(64)(65). In regard to the second rectangular frame (51) a corresponding second panel (4B) can be secured to the second rectangular framework (51) abutting the panel second side (110) against the leg outer face (91) of the first pair of angled members (89)(90) and the leg outer face (98) of the second pair of angled members (93)(94) and extend to the periphery of the second rectangular frame (51). In regard to the first rectangular frame (50) a corresponding first panel (4A) can have the panel second side (110) secured to the outer face (71) of the first pair of angled members (52)(53) and extend to the periphery established by each of the first pair of angled members (52)(53) and can be secured to the outer face (70) of the second pair of angled members (64)(65) to extend beyond each of the second pair of angled members (64)(65) a distance sufficient to cover one or more of the outer face (99) of the first leg (97) of the second pair of angled members (93)(94) and the corner tube first end (73) of rectangular corner tube (72) of the second rectangular frame (51) and can further extend to cover the second panel edge (107) and further extend to cover the finish material (100).

Now, with general reference to FIGS. 2 through 6 and 8 through 12, in particular embodiments, the enclosure sides (105) as above described can be transported without the panel finish layer (5) which can be applied in-situ. In other embodiments, the panel finish layer (5) can be affixed to the panels (4) as part of a pre-fabricated enclosure side (105). In particular embodiments, the panel finish layer (5) can extend beyond one or both of the adjacent panel edges (106)(107) disposed at an enclosure corner (108) of the enclosure (1) to cover the exposed abutted adjacent panel edges (106)(107) of the panels (4)(4A)(4B).

Figure 6:
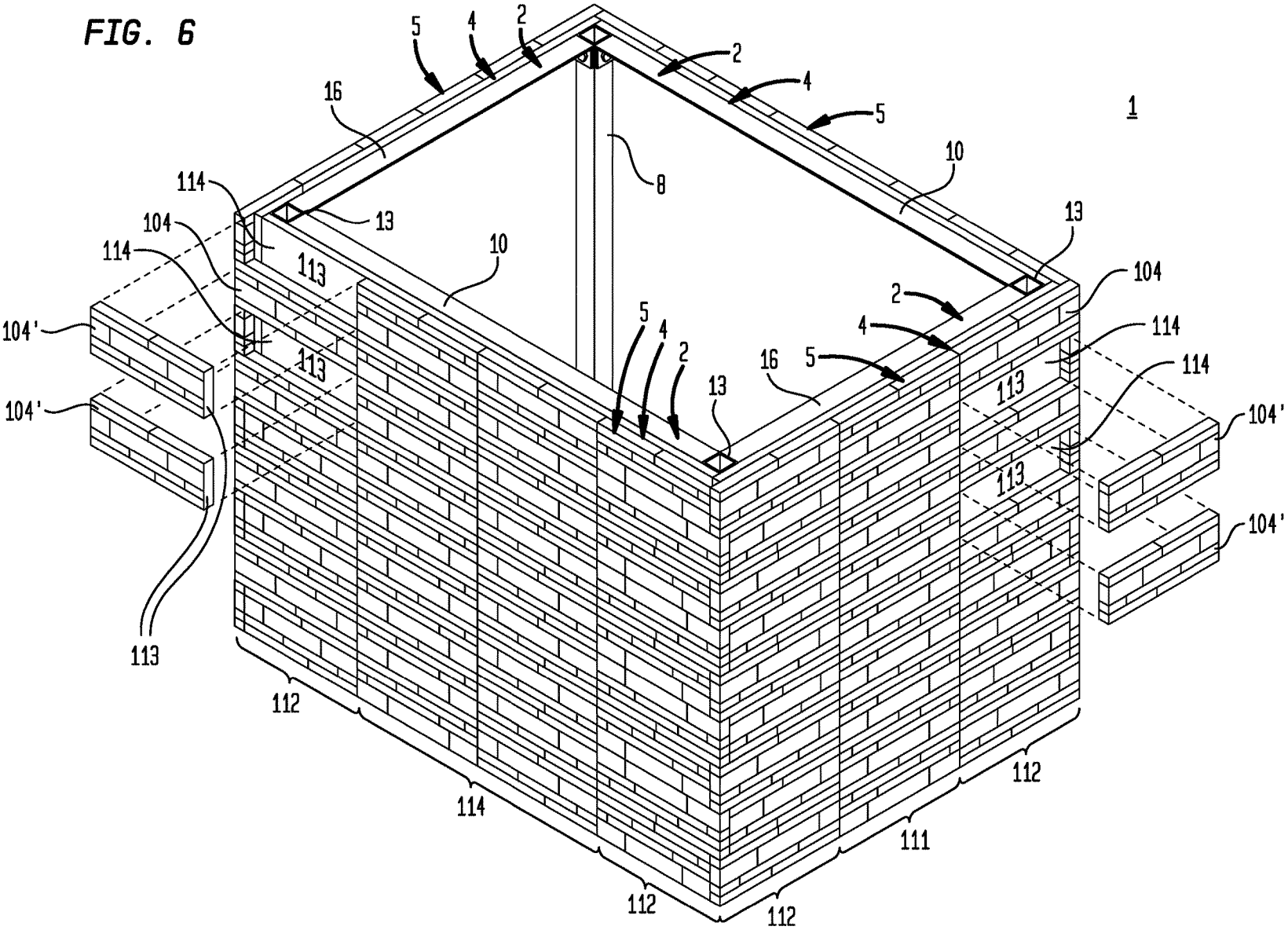
FIG. 6 is an illustration of an embodiment of an enclosure assembled from a pair of the first side panels depicted in FIG. 2 and a pair of the enclosure second side panel depicted in FIG. 3 and further depicting a finish layer optionally affixed in part after assembly of the enclosure first side panel depicted in FIG. 2 to the enclosure second side panel depicted in FIG. 3.
Figure 7:
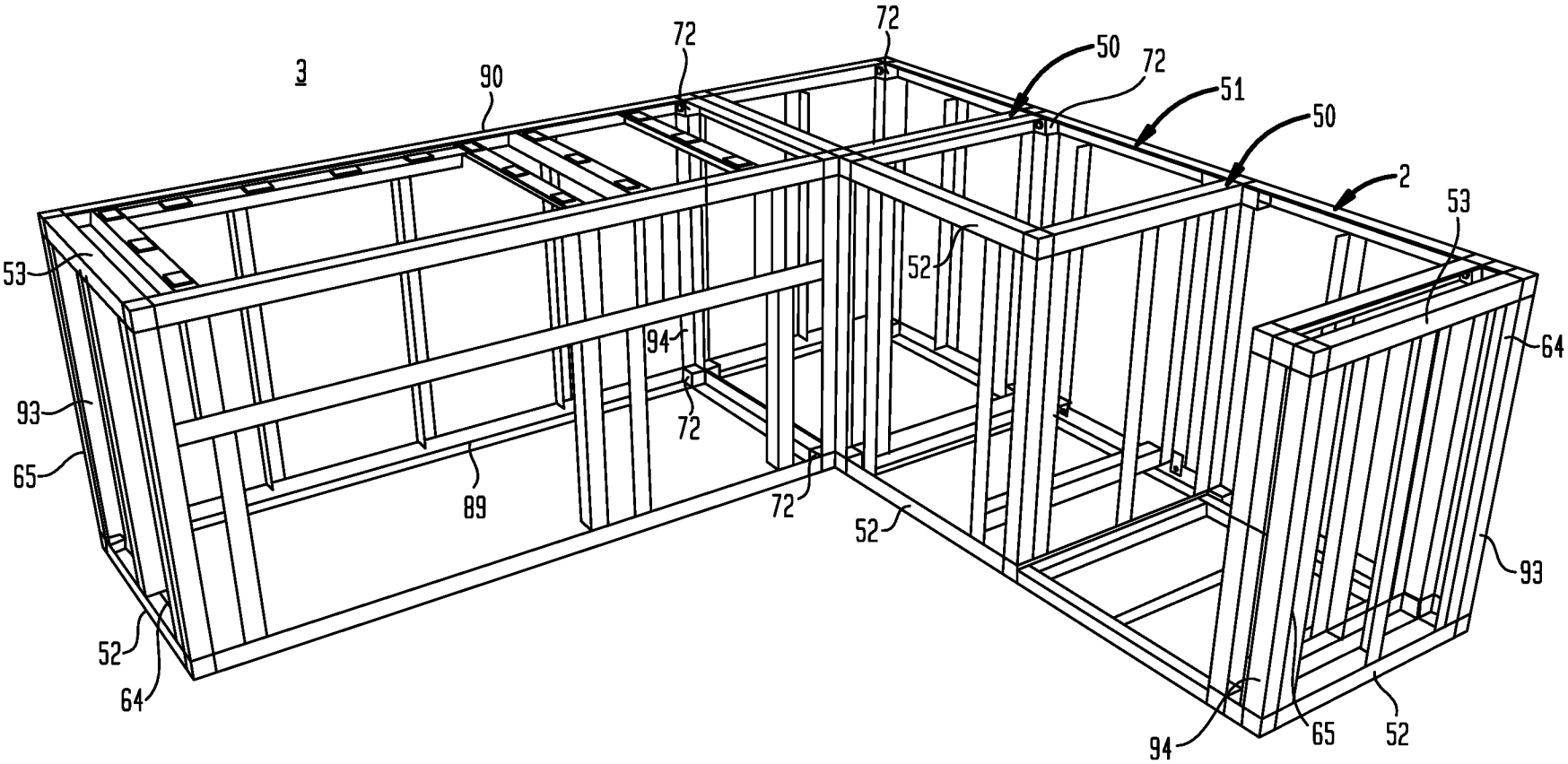
FIG. 7 is an illustration of a framework in accordance with a particular embodiment of the invention.

Again, with primary reference to 2 through 6 and FIGS. 8 through 12, in particular embodiments, a plurality of panels (4) can be configured to have adjacent panel edges (106)(107) when attached to the assembled first or second rectangular frames (50)(51). The plurality of panels (4) can be disposed on a work surface with the adjacent panel edges (106)(107) disposed proximate one another allowing masonry blocks (104) to be secured to the panel first side medial portions (111) in patterns that extend or can be extended beyond the adjacent panel edges (106)(107) to cover the adjacent panel edges (106)(107) at the enclosure corners (108) of the framework (3) (as shown in the examples of FIGS. 4 and 10). In particular embodiments, the masonry blocks (104) that fill the first side margin portions (112) to extend beyond the adjacent panel edges (106)(107) can be removably fitted into the pattern of masonry blocks (104) secured to the panel first side medial portions (111) (as shown in the example of FIGS. 6 and 12). Once fitted into the pattern of masonry blocks (104) secured to the panel first side medial portions (111) in a configuration which assures that upon joining the enclosures sides, the removably fitted masonry blocks (104') will extend beyond the adjacent panel edges (106)(107) and complete the pattern of masonry blocks (104) at the enclosure corners (108) of the framework (3), the removably fitted masonry blocks (104') can be removed from the panel first side margin portions (112) (as shown in the example of FIGS. 6 and 12). The removably fitted masonry blocks (104') upon removal can be marked with cross reference indicia (113) to the fitment locations (114) on the panel first side margin portions (112) of the panel (4). The panels (4) having the removably fitted masonry blocks (104') removed from the panel first side margin portions (112) can be packaged for transport. The panels (4) having only the masonry blocks (104) secured to the first panel side medial portions (111) can avoid having masonry blocks (104) extending beyond the panel edge (106)(107) conferring the advantage of transporting a panel (4) including masonry blocks (104) secured to the a substantial portion of the panel first side (109) to reduce expenditure of time and labor to in situ secure those masonry blocks (104) to the panels (99) of the enclosure (3) and further confers the benefit of transporting panels (4) without masonry blocks (104) extending beyond the panel edges (106)(107) which substantially reduces damage to the masonry blocks (104) during transport. The removably fitted masonry blocks (104') removed from the panel first side margin portions (112) can, but need not necessarily, be packaged separate from the panels (99) for transport.

Now, with primary reference to FIGS. 4 and 10, in particular embodiments, the kit comprising a plurality of pre-fabricated enclosure sides (105), optionally along with masonry blocks (104) secured to the panel (4) first side medial portions (111), and the removably fitted masonry blocks (104'), can be packaged together or separately for transport. In particular embodiments, all the separate pieces of the kit to assemble the enclosure (1) can be disposed in one or more flat-pack(s) for transport.

Now, with general reference to FIGS. 1 through 12, in particular embodiments, a method of assembling the enclosure (1) in situ from the kit comprising the plurality of frame members (2), the panels (4), and the panel finish layer (5) which optionally may include masonry blocks (104) secured to the panel first side medial portions (111), and the removably fitted masonry blocks (104') can, but need not necessarily, comprise assembling the plurality of frame members (2) by interconnecting the plurality of frame members (2) to generate the framework (3). In particular embodiments, interconnecting the plurality of frame members (2) results in a first end frame (6) and a second end frame (7) and interconnecting the plurality of cross members (16)(17)(19)(20) having crossmember first ends (14) and cross member second ends (15) to the first and second end frames (6)(7) define the enclosure front frame (18), the enclosure rear frame (21). However, while the illustrative method results in a generally rectangular framework (3); this illustrative example for the method does not preclude assembling embodiments of the framework (3) that define any polygonal structure, such as: triangle, square, rectangle, pentagon, hexagon or combinations thereof.

Now, with general reference to FIGS. 1 through 12, in particular embodiments, a method of assembling the enclosure (1) in situ from the kit can include connecting a plurality of panels (4) to the framework (3) whereby the plurality of panels (4) have adjacent panel edges (106)(107) disposed at one or more enclosure corners (108) of the framework (3). In the illustrative example including a generally rectangular framework (3), the method can include connecting a plurality of panels (4) to at least one of the enclosure front frame (18) or the enclosure rear frame (21) and at least one of the first end frame (6) or the second end frame (7), whereby the panels (4) connected to the at least one of the enclosure front frame (18) or the enclosure back frame (19) and to at least one of the first end frame (6) or the second end frame (7) have adjacent panel edges (106)(107) disposed at least one corner of the generally rectangular framework (3).

In those embodiments, in which the panel first side (109) has masonry blocks (104) secured to the panel first side medial portion (111) with panel first side margin portions (112) extending to the adjacent side edges (106)(107, the method can further include fastening the plurality of panels (4) to the framework (3) with adhesives on the panel second side (110) or fasteners (115) disposed in the panel first side margin portion (112) (as shown in the example of FIGS. 4 and 10), including as illustrative examples: screws, bolts, rivets, or the like.

Now, with primary reference to FIGS. 6 and 12, a method of assembling the enclosure (3) in situ from the kit can further include securing a plurality of masonry blocks (104') to the panel first side margins (112). The masonry blocks (104') secured to the panel first side margin portions (112) can, but need not necessarily, overlap the adjacent panel edges (106) (107) to cover the adjacent panel edges (106) (107) or the framework corners (108). In particular embodiments, the plurality of masonry blocks (104') secured to the first side margin portions (112) of a first panel (4A) can in part or in whole extend flush or substantially flush with the corresponding first panel edge (106) allowing a plurality of masonry blocks (104') secured to the first side margins (112) of a second panel (99B) to extend beyond the second panel edge (107) to overlap the plurality of masonry blocks (104') secured to the first side margin portions (112) of the first panel (99A) or the first side margin portions (112) of the second panel (99B) to cover the framework corner (108).

Now, with primary reference to FIGS. 7 through 12, in particular embodiments, the method can include one or more of: joining a first rectangular frame (50) (or other first polygonal frame) to a second rectangular frame (51) (or other second polygonal frame) by aligning the end piece apertures (63) of the first rectangular frame (50) with the apertured fittings (78) disposed in the corner tube first side (74) of the rectangular corner tubes (72) to allow a mechanical fastener (79) to pass through the end piece apertures (63) and matingly engage the apertured fitting (78) disposed in the corner tube first side (74) of the rectangular corner tubes (72). As shown in the illustrative example of FIG. 10, a pair of first rectangular frames (50')(50") can be joined by mechanical fasteners (79) to a pair of second rectangular frames (51')(51") to assemble a framework (3) defining a rectangular volume.

As can be easily understood from the foregoing, the basic concepts of the present invention may be embodied in a variety of ways. The invention involves numerous and varied embodiments of an enclosure and methods for making and using such enclosure including the best mode.

As such, the particular embodiments or elements of the invention disclosed by the description or shown in the figures or tables accompanying this application are not intended to be limiting, but rather exemplary of the numerous and varied embodiments generically encompassed by the invention or equivalents encompassed with respect to any particular element thereof. In addition, the specific description of a single embodiment or element of the invention may not explicitly describe all embodiments or elements possible; many alternatives are implicitly disclosed by the description and figures.

It should be understood that each element of an apparatus or each step of a method may be described by an apparatus term or method term. Such terms can be substituted where desired to make explicit the implicitly broad coverage to which this invention is entitled. As but one example, it should be understood that all steps of a method may be disclosed as an action, a means for taking that action, or as an element which causes that action. Similarly, each element of an apparatus may be disclosed as the physical element or the action which that physical element facilitates. As but one example, the disclosure of a "enclosure" should be understood to encompass disclosure of the act of "enclosing"—whether explicitly discussed or not—and, conversely, were there effectively disclosure of the act of "enclosing", such a disclosure should be understood to encompass disclosure of an "enclosure" and even a "means for enclosing." Such alternative terms for each element or step are to be understood to be explicitly included in the description.

In addition, as to each term used it should be understood that unless its utilization in this application is inconsistent with such interpretation, common dictionary definitions should be understood to be included in the description for each term as contained in the Random House Webster's Unabridged Dictionary, second edition, each definition hereby incorporated by reference.

All numeric values herein are assumed to be modified by the term "about", whether or not explicitly indicated. For the purposes of the present invention, ranges may be expressed as from "about" one particular value to "about" another particular value. When such a range is expressed, another embodiment includes from the one particular value to the other particular value. The recitation of numerical ranges by endpoints includes all the numeric values subsumed within that range. A numerical range of one to five includes for example the numeric values 1, 1.5, 2, 2.75, 3, 3.80, 4, 5, and so forth. It will be further understood that the endpoints of each of the ranges are significant both in relation to the other endpoint, and independently of the other endpoint. When a value is expressed as an approximation by use of the antecedent "about," it will be understood that the particular value forms another embodiment. The term "about" generally refers to a range of numeric values that one of skill in the art would consider equivalent to the recited numeric value or having the same function or result. Similarly, the antecedent "substantially" means largely, but not wholly, the same form, manner or degree and the particular element will have a range of configurations as a person of ordinary skill in the art would consider as having the same function or result. When a particular element is expressed as an approximation by use of the antecedent "substantially," it will be understood that the particular element forms another embodiment.

Moreover, for the purposes of the present invention, the term "a" or "an" entity refers to one or more of that entity unless otherwise limited. As such, the terms "a" or "an", "one or more" and "at least one" can be used interchangeably herein.

Thus, the applicant(s) should be understood to claim at least: i) each of the enclosure herein disclosed and described, ii) the related methods disclosed and described, iii) similar, equivalent, and even implicit variations of each of these devices and methods, iv) those alternative embodiments which accomplish each of the functions shown, disclosed, or described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) methods and apparatuses substantially as described hereinbefore and with reference to any of the accompanying examples, x) the various combinations and permutations of each of the previous elements disclosed.

The background section of this patent application provides a statement of the field of endeavor to which the invention pertains. This section may also incorporate or contain paraphrasing of certain United States patents, patent applications, publications, or subject matter of the claimed invention useful in relating information, problems, or concerns about the state of technology to which the invention is drawn toward. It is not intended that any United States patent, patent application, publication, statement or other information cited or incorporated herein be interpreted, construed or deemed to be admitted as prior art with respect to the invention.

The claims set forth in this specification, if any, are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent application or continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

Additionally, the claims set forth in this specification, if any, are further intended to describe the metes and bounds of a limited number of the preferred embodiments of the invention and are not to be construed as the broadest embodiment of the invention or a complete listing of embodiments of the invention that may be claimed. The applicant does not waive any right to develop further claims based upon the description set forth above as a part of any continuation, division, or continuation-in-part, or similar application.

What is claimed is:

1. An enclosure, comprising:

a first side frame, including:

a first pair of angled members having a first leg orthogonally joined to a second leg and having a length disposed between opposite first and second ends;

a pair of angled member end pieces each having opposite faces extending to end piece edges each having an end piece aperture communicating between said opposite faces, one of said pair of angled member end pieces joined to an inner face of said first and second leg to dispose one of said opposite faces proximate a corresponding one of said first or second ends of each of said first pair of angled members;

a second pair of angled members each having a first leg orthogonally joined to a second leg and having a length disposed between opposite first and second ends, a first of said second pair of angled members having first and second ends correspondingly joined to said first ends of said first pair of angled members, a second of said second pair of angled members having said first and second ends correspondingly joined to said second ends of said first pair of angled members, wherein an outer face of said first leg of each of said second pair of angled members disposed generally flush with an outer face of said first leg of said first pair of angled members, wherein an outer face of said second leg of each of said second pair of angled members generally aligned to a corresponding one of said first or second ends of each of said first pair of angled members to generate an enclosure first side frame;

a second side frame, including:

a plurality of rectangular tubes each having a first open end opposite a second open end and having a first side opposite a second side, said first side having an apertured fitting adapted to matingly receive a fastener;

a plurality of angled members each having a first leg orthogonally joined to a second leg, said plurality of angled members having opposite ends correspondingly joined to adjacent pairs of said plurality of rectangular tubes, said first leg having an outer face disposed generally flush with said second side of said adjacent pairs of said rectangular tubes, said second leg having an outer face disposed flush with said first open end or a third side of said adjacent pairs of said plurality of rectangular tubes and extending toward said first side of said adjacent pairs of said rectangular tubes to generate an enclosure second side frame.

2. The enclosure of claim 1, further comprising a mechanical fastener disposed in each end piece aperture and correspondingly matingly received by said apertured fitting to secure said pair of angled members of said first side frame to said adjacent pairs of rectangular tubular members of said second side frame, thereby joining said first and second side frames.

3. The enclosure of claim 2, further comprising:

a first panel fastened to said first side frame and a second panel fastened to said second side frame prior to joining said enclosure first side frame to said enclosure second side frame.

4. The enclosure of claim 2, further comprising a finish layer affixed to said first panel and said second panel after joining said enclosure first side frame to said enclosure second side frame.

5. The enclosure of claim 3, wherein said second panel extends to the periphery of said second side frame, and wherein said first panel extends beyond said second pair of angled members to abut said first panel in an enclosure corner.

* * * * *